United States Patent [19]

Kunst et al.

[11] Patent Number: 5,070,794

[45] Date of Patent: Dec. 10, 1991

[54] SECTIONED DOOR ASSEMBLY FOR RAILWAY VEHICLE

[75] Inventors: Robert J. Kunst, Crownpoint, Ind.; Yvan Gosselin, La Pocatiére, Canada

[73] Assignee: Bombardier Inc., Boucherville, Canada

[21] Appl. No.: 601,432

[22] Filed: Oct. 23, 1990

[51] Int. Cl.[5] ..... B60R 3/00

[52] U.S. Cl. ..... 105/436; 182/91; 280/166

[58] Field of Search ..... 105/433, 436, 437, 438, 105/429, 443, 447, 448, 449; 182/91, 95, 96; 244/129.5, 129.6; 280/166

[56] References Cited

U.S. PATENT DOCUMENTS

| | | | |
|---|---|---|---|
| 3,166,277 | 1/1965 | Brison et al. | 182/91 |
| 4,020,920 | 5/1977 | Abbott | 182/91 |
| 4,140,327 | 2/1979 | Hackney | 280/166 |
| 4,175,495 | 11/1989 | Kleim | 105/438 |

*Primary Examiner*—Joseph F. Peters, Jr.

*Assistant Examiner*—Virna Lissi Mojica

*Attorney, Agent, or Firm*—Oblon, Spivak, McClelland, Maier & Neustadt

[57] ABSTRACT

A rail vehicle sectioned door assembly for a door opening having a stairwell. The assembly comprises a sliding door having a door upper section and lower section slidingly interconnected together by a lock assembly. The door lower section is provided with guide rails to position same adjacent the stairwell. A stairwell platform is hingedly connected to one side of an upper horizontal plane of the stairwell. The platform is releasably secured in a retracted position clear of the upper horizontal plane and the stairwell. The platform is displaceable to lie in the horizontal plane, in a position of use, and is supported thereon. The lock is disengaged by the platform when displaced to its position of use to disconnect the door upper section from the door lower section whereby to permit the upper section to slide open while the lower section closes a lower portion of said opening below the platform.

9 Claims, 2 Drawing Sheets

SECTIONED DOOR ASSEMBLY FOR RAILWAY VEHICLE

BACKGROUND OF INVENTION

1. Field of the Invention

The present invention relates to a rail vehicle sectioned door assembly for a door opening having a stairwell whereby to provide a threshold platform above the stairwell for disembarkment through an upper door section, when required.

2. Description of Prior Art

In passenger rail vehicles, there is usually provided a stairwell at opposite ends of railway cars and having with a threshold plate at the bottom of the stairwell whereby people can safely disembark from the railway vehicle onto a platform at a train station or on ground or alternatively on a further stairwell. The threshold or stairwell in railway cars is at a fixed elevation relative to ground and this presents a problem to unloading passengers on platform which are elevated above the threshold. When such is the case, it is necessary to place a board or a platform to bridge the stairwell. This is a time-consuming, labor-intensive and dangerous for the passengers and operators. It also delays the train due to the fact that all of these bridges must be removed before the many vehicles of the train before it can pull away from the station.

SUMMARY OF INVENTION

It is a feature of the present invention to provide a rail vehicle sectioned door assembly for a door opening having a stairwell and including a displaceable platform which locks with a lower door section and provides an inner discharge platform which substantially overcomes the above-mentioned disadvantages.

Another feature of the present invention is to provide a rail vehicle sectioned door assembly for a door opening having a stairwell and wherein the assembly comprises a sliding door having a door upper section and lower section slidingly interconnected together and wherein a stairwell platform is displaceably positioned over the stairwell to elevate the threshold to a position above the existing stairwell for exiting through the door upper section only and wherein the door lower section is secured to the platform.

Another feature of the present invention is to provide a rail vehicle sectioned door assembly for a door opening having a stairwell and wherein the sliding door has a door upper section and lower section slidingly interconnected together so that both sections can be opened together when the stairwell is liberated or only the upper section can be slidingly opened when a stairwell platform is positioned over the stairwell and further wherein the door assembly and platform are easy to use, safe and permits quick loading and unloading of passengers or material from an elevated platform at a train station.

According to the above features, from a broad aspect, the present invention provides a rail vehicle sectioned door assembly for a door opening having a stairwell. The assembly comprises a sliding door having a door upper section and lower section slidingly interconnected together by a lock means. The door lower section is provided with guide means to position same adjacent the stairwell. The stairwell platform is hingedly connected to one side of an upper horizontal plane of the stairwell. Means is provided to releasably secure the platform in a retracted position clear of the upper horizontal plane and the stairwell. Support means is provided to maintain the platform in the horizontal plane when the platform is displaced to a position of use. Lock disengaging means is provided to disconnect the lock means when the platform is positioned to the said position of use to disconnect the door upper section from the lower section to permit the upper section to slide open while the lower section closes a lower portion of the opening below the platform.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
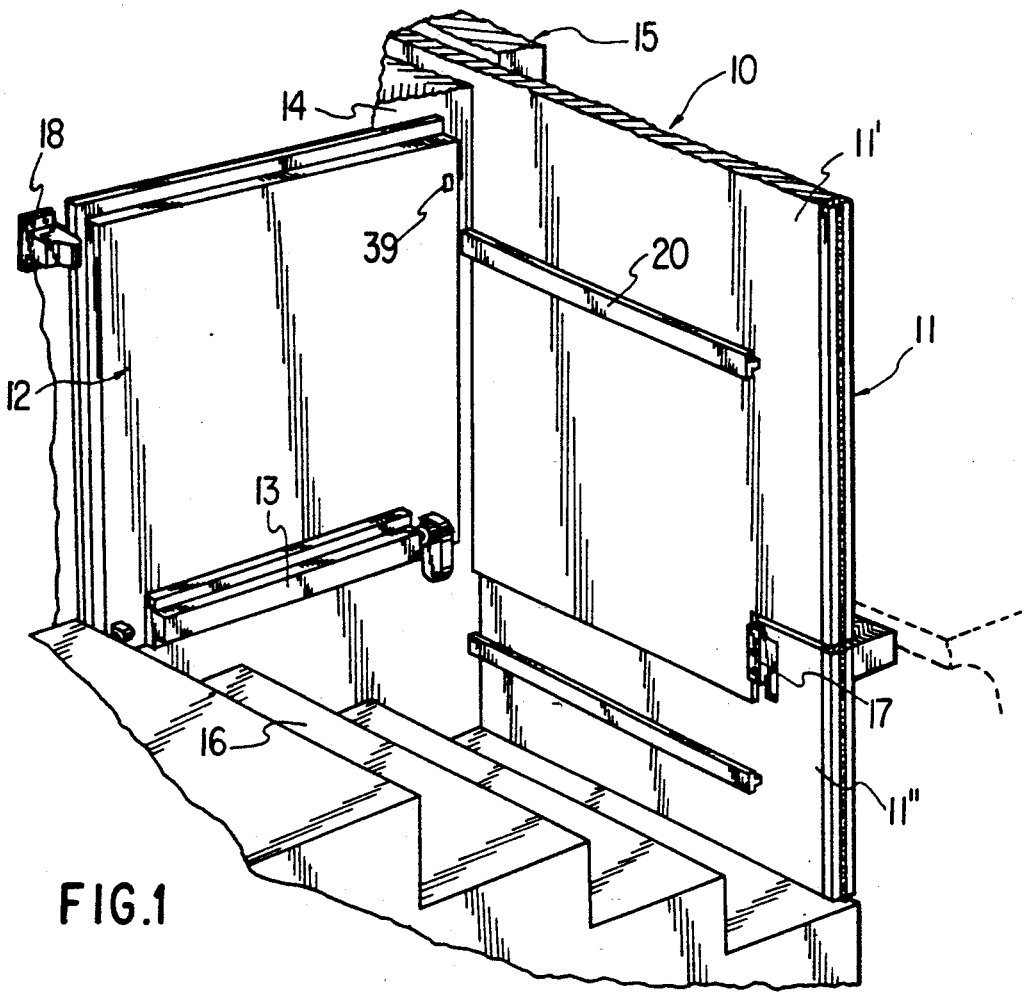
FIG. 1 is a fragmented perspective view illustrating the rail vehicle section door assembly secured in a door opening having a stairwell.
Figure 2:
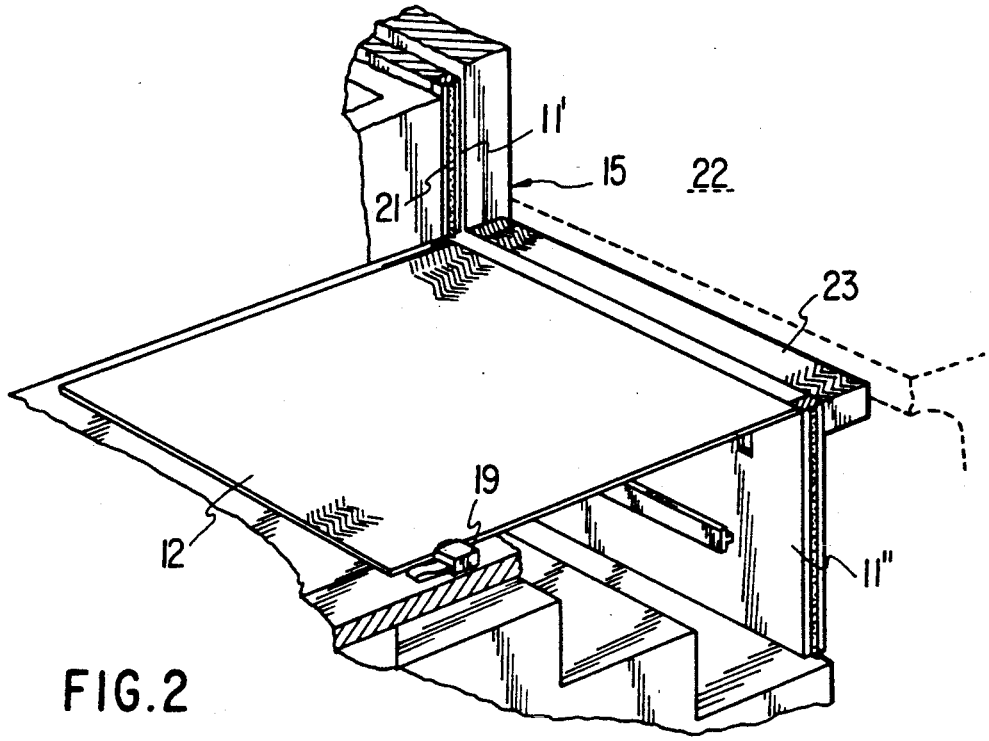
FIG. 2 is a perspective view, similar to FIG. 1, but showing the stairwell platform in its position of use and the door upper section opened with the vehicle positioned adjacent an elevated platform at a train station.

Referring now to the drawings, and more particularly to FIGS. 1 and 2, there is shown generally at 10, a door opening of a railway vehicle provided with the sectioned door assembly 11 and the stairwell platform 12 of the present invention. The platform 12 is hingedly secured by a hinge 13 provided at its lower edge to a side wall 14 of the railway vehicle 15 which is adjacent the stairwell 16. The stairwell 16 permits the discharge of passengers through the door opening 10 so that passengers can disembark from the rail vehicle at a level which usually does not require a platform.

The door assembly 11 is comprised of a door upper section 11' and a door lower section 11". Both these sections are interconnected together by a lock means 17 which will be described later. The stairwell platform 12 is retained adjacent the side wall 14 by a releasable securing latch 18. By unlocking the latch 18, the stairwell platform 12 can be lowered to its position of use, as shown in FIG. 2, when the platform lies in the upper horizontal plane of the stairwell 16. A support lock means 19 which can also be a latch retains the platform secured in this horizontal plane.

When the stairwell platform 12 is in its position of use, as shown in FIG. 2, the lock means 17 is actuated by the stairwell platform and disconnects the door upper section from the lower section. The door lower section 11" then becomes connected to the stairwell platform 12 preventing it from opening. The door upper section 11' can then be slid open on guide rails 20 to position the door upper section 11' in a door receiving cavity 21 provided in a side frame of the railway vehicle 15. Accordingly, passengers or commodities can be discharged from the railway vehicle at a higher level which is aligned with elevated platforms, such as at 22, provided at railway stations or elsewhere. The upper outer section of the lower door section 11" may also be provided with a fixed threshold member 23 which extends outwardly to be positioned close to the elevated platforms 22.

Figure 3:
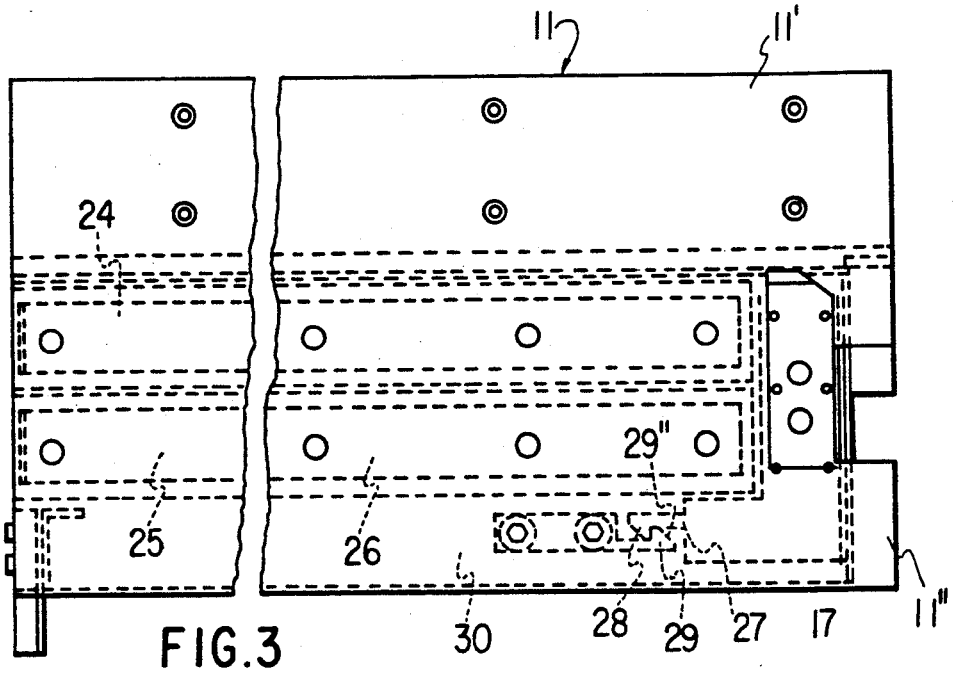
FIG. 3 is a fragmented perspective view illustrating the position of the detachable lock interconnecting the door upper section to the door lower section.
Figure 5:
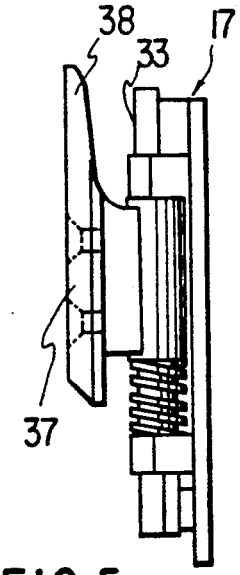
FIG. 5 is a side view of the lock assembly of FIG. 4 but showing the platform engaging members secured to the assembly.
Figure 6:
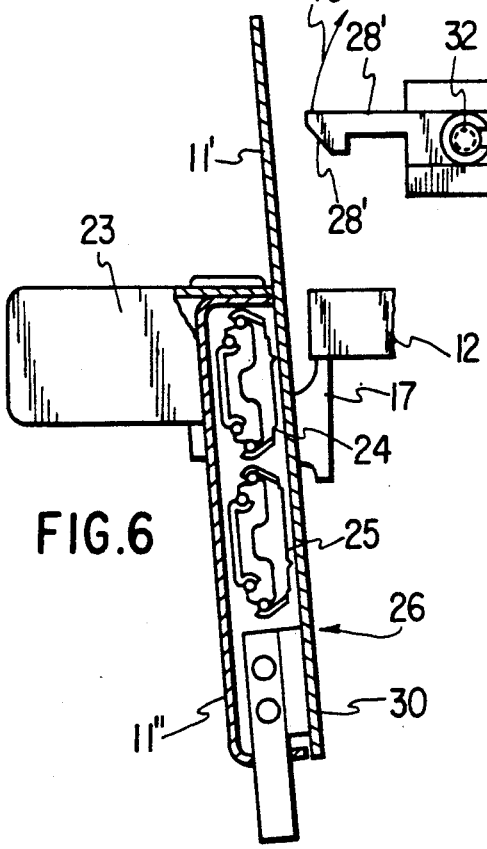
FIG. 6 is a section view showing the slide interconnection between the door upper section and lower sections.

Referring now additionally to FIGS. 3 to 6, there will be described the construction and operation of the lock means 17. As shown in FIGS. 3 and 6, the door upper section 11' is slidingly connected to the lower section 11" through a pair of horizontal slide rails 24 and 25, the construction of which is well known in the art. These rails are positioned within an overlap section 26 of the door assembly 11. The lock means 17 consists of a pivotal latch member 27 which is secured to the door lower section 11" and provided with a hook end 28 for engagement with a catch element 29 which is connected to the door upper section, herein the overlap wall section 30. The hook end 27 is spring-biased to its position as shown in FIG. 3 and when the door upper section is slid closed, the catch sloping front wall 29' engages the sloping front wall 28' of the hook end 28 causing the hook end to rise and automatically engage with the catch to secure both door sections together.

Figure 4:
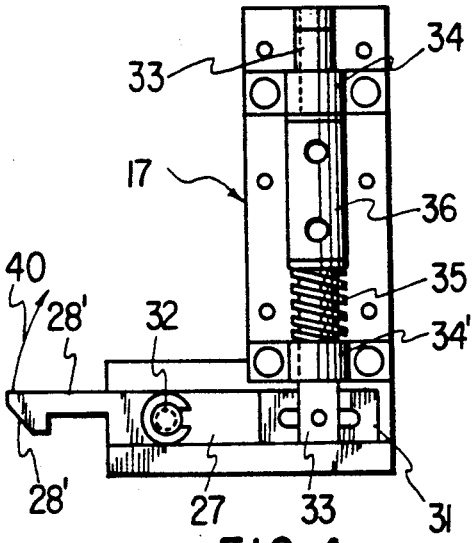
FIG. 4 is a detailed plan view of the lock assembly.

Referring now to FIGS. 4 and 5, there is show the construction of the pivotal latch member 27. As herein shown, the pivotal latch member 27 is an elongated bar having the hook end 28' at one end and an actuating end 31 at an opposite end. A pivot pin 32 is provided intermediate the hook end and actuating end. A vertical rod 33 is secured to the actuating end 31. A helical spring 35 is provided about the rod 33 between a lower guide element 34' and a rod attachment member 36 whereby to spring bias the rod 33 upwardly to maintain a pulling pressure on the actuating end 31 of the pivot latch member 27 so as to maintain the hook end 28 at its locked position as shown in FIG. 4.

A platform engaging member 37, as shown in FIG. 5, is secured to the rod attachment member 36 and is provided with a platform engaging upper end 38 which is received within an engaging cavity 39, see FIG. 1, provided in the lower face of the stairwell platform 12. When the stairwell platform 12 is lowered to its position of use as shown in FIG. 2, the platform engaging member is caused to move downwardly causing the rod 33 to move downward against the spring action of the helical spring 35 causing the pivot latch member to pivot with the hook end 28 moving upwardly in the direction of arrow 40, as shown in FIG. 4. This causes the pivot latch member 27 to disengage with the catch 29 thus disengaging the door upper section 11' from the door lower section 11". At the same time, the platform is engaged to the door lower section through the engaging cavity 39 and the engaging member 37 preventing the door lower section from being opened. The support locking member 19 also prevents the platform 12 from being retracted and secures the door lower section 11" to the structure of the railway vehicle. For added security, the support locking member 19 may be a key operated lock member. This could also be the case with the latch 18 which is secured to the side wall 14 adjacent the stairwell 16. Accordingly, only an authorized operator could position the platform over the stairwell, when necessary, and disengage the stairwell platform to place it to its stored position, when not necessary.

It is within the ambit of the present invention to cover any obvious modifications of the example of the preferred embodiment described herein, provided such modifications fall within the scope of the appended claims.

We claim:

1. A rail vehicle sectioned door assembly for a door opening having a stairwell, said assembly comprising a sliding door having a door upper section and lower section slidingly interconnected together by a lock means, said door lower section being provided with guide means to position same adjacent to said stairwell, a stairwell platform is hingedly connected to one side of an upper horizontal plane of said stairwell, means to releasably secure said platform in a retracted position clear of said upper horizontal plane and said stairwell, support means to maintain said platform in said horizontal plane when said platform is displaced to a position of use, lock disengaging means to disconnect said lock means when said platform is positioned to and position of use to disconnect said door upper section from said lower section to permit said upper section to slide open while said lower section closes a lower portion of said opening below said platform.

2. A sectioned door assembly as claimed in claim 1 wherein said lock means comprises a pivotal latch member secured to said door lower section and having a hooked end for engagement with a catch connected to said door upper section, said pivotal latch being spring biased in engagement with said catch when both said door sections are in a closed position.

3. A sectioned door assembly as claimed in claim 2 wherein said pivotal latch is provided with an actuating end opposite said hook end, a pivot intermediate said hook end and said actuating end, an actuating rod secured to said actuating end and spring biased in a predetermined direction to maintain said hook end in an engaged position and to permit automatic engagement with said catch when said catch is displaced thereagainst by the closing of said sliding door upper section.

4. A sectioned door assembly as claimed in claim 3 wherein said lock disengaging means is a platform engaging member secured to said actuating rod to urge said rod against said spring bias by the weight of said platform when it is displaced to said position of use, said rod displacement causing said hook end to pivot to disengage with said catch to disconnect said door upper section from said door lower section.

5. A sectioned door assembly as claimed in claim 4 wherein said platform is provided with an engaging cavity to receive a portion of said platform engaging member to secure said door lower section to said platform through said lock means.

6. A sectioned door assembly as claimed in claim 1 wherein said guide means comprises horizontal slide rails connected to said door lower section and a side frame of said door opening, and further horizontal slide rails connected to said door upper section and a side frame of said door opening.

7. A sectioned door assembly as claimed in claim 6 wherein said door upper section and lower section are displaceably interconnected by an interconnecting guide rail assembly disposed below said horizontal plane.

8. A sectioned door assembly as claimed in claim 1 wherein said means to releasably secure said platform in a retracted position is a latch secured to a side .wall of said rail vehicle adjacent said stairwell.

9. A sectioned door assembly as claimed in claim 1 wherein said support means is comprised of a support lock means to secure said platform in said position of use.

* * * * *